United States Patent [19]

Diehl

[11] Patent Number: 4,683,073

[45] Date of Patent: Jul. 28, 1987

[54] BUILDER FOR WASHING AGENTS

[76] Inventor: Manfred Diehl, Zeisselstrasse 7, D-6000 Frankfurt 1, Fed. Rep. of Germany

[21] Appl. No.: 827,056

[22] Filed: Feb. 7, 1986

[30] Foreign Application Priority Data

Feb. 9, 1985 [DE] Fed. Rep. of Germany ..... 3504450

[51] Int. Cl.[4] ..... C11D 7/14

[52] U.S. Cl. ..... 252/135; 252/140; 252/174.17; 252/174.21; 252/174.25; 252/525; 252/DIG. 15

[58] Field of Search ..... 252/135, 140, 174.17, 252/174.21, DIG. 15, 174.25, 525

[56] References Cited

U.S. PATENT DOCUMENTS 4,169,075 9/1979 Kuhling et al. ..... 252/173
4,215,007 7/1980 Krings et al. ..... 252/174.25

FOREIGN PATENT DOCUMENTS 1529454 10/1978 United Kingdom .

*Primary Examiner*—Paul Lieberman
*Assistant Examiner*—Hoa Van Le
*Attorney, Agent, or Firm*—Cushman, Darby & Cushman

[57] ABSTRACT

There is prepared a granulated washing agent builder consisting of 70 to 80 wt. % of a water insoluble silicate capable of binding calcium, the silicate being in the form of a finely divided, bound water containing, synthetically produced crystalline compound of the general formula $$(Kat_{2/n}O)_x.Me_2O_3.(SiO_2)_y \quad (I).$$

in that Kat is a cation exchangeable with calcium and having the valence n, x is a number from 0.7 to 1.5, Me is boron or aluminum and y is a number from 0.8 to 6, 4 to 5 Wt.-% sodium sulfate
2 to 3 Wt.-% nonionic tenside
0 to 1 Wt.-% alkali
0.5 to 1 Wt.-% carboxymethylcellulose, methylcellulose or a mixture thereof
balance Water.

5 Claims, 1 Drawing Figure

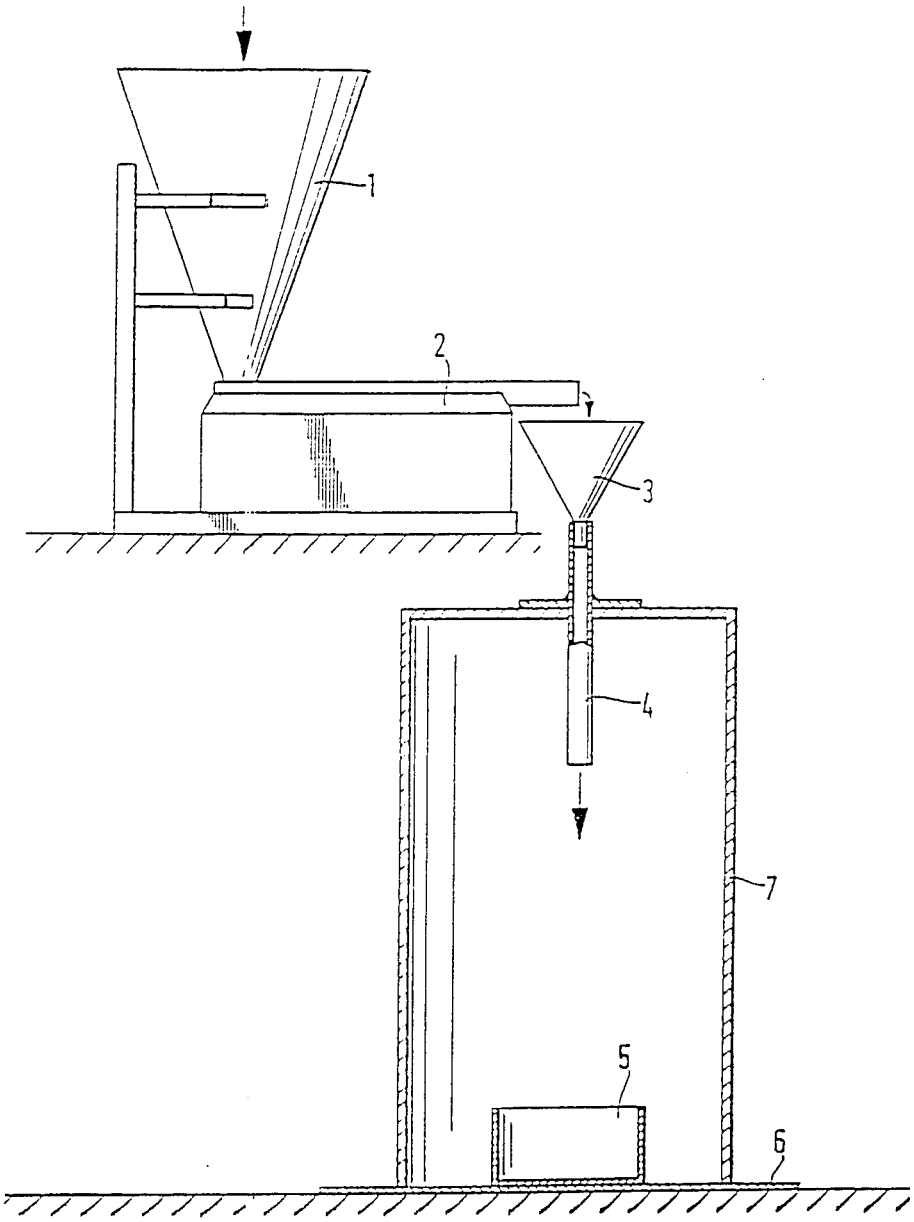
1
2
3
4
5
6
7

BUILDER FOR WASHING AGENTS

BACKGROUND OF THE INVENTION

Powdery zeolite of Type A, which can be employed as a phosphate substitute in washing agent, because of its small particle size represents a clumpy powder which is inclined to agglomerate. It is difficult to mix this zeolite powder with the rest of components of the washing agent to form a homogeneous powder. The problem is aggravated by the fact that the finished mixture has a tendency to separate into its components again.

In order to avoid this mixing problem, there have already been added zeolite granulates to the spray dried washing agent components. These zeolite granulates are produced, inter alia, by spray drying an aqueous suspension of the zeolite powder with addition of further components of the washing agent.

It is known to treat zeolite suspension with sodium sulfate, spray dry to zeolite granulates and to mix in the remaining washing agent components (cf. European published patent application No. 870, Kali Chemie). These known zeolite granulates have the disadvantage that they do not fulfill the requirements placed on them. Thus, it is necessary that the zeolites have an undiminished calcium binding capacity, a good redispersibility and a good transportation and particle stability. Of especial importance is the lowest possible dust content.

SUMMARY OF THE INVENTION

The invention is directed to a granulated washing agent builder consisting of 70 to 80 wt. % of a water insoluble, silicate capable of binding calcium, the silicate being in the form of a finely divided, bound water containing, synthetically produced crystalline compound of the general formula $$(Kat_{2/n}O)_x.Me_2O_3.(SiO_2)_y \quad (I),$$

in that Kat is a cation exchangeable with calcium and having the valence n, x is a number from 0.7 to 1.5, Me is boron or aluminum and y is a number from 0.8 to 6, 4 to 5 Wt.-% sodium sulfate
2 to 3 Wt.-% nonionic tenside
0 to 1 Wt.-% alkali
0.5 to 1 Wt.-% carboxymethylcellulose, methylcellulose or a mixture thereof
balance Water.

The washing agent builder of the invention can contain the component of formula I in crystalline form.

Preferably, in the components of formula I there is employed an aluminum silicate.

In formula I, y can be a number from 1.3 to 4.

The crystalline components of formula I in a preferred form can be a zeolite of Type A.

The aluminum silicate according to formula I can be a naturally present one or can be produced synthetically, with the synthetically produced products being preferred. The production, e.g., can be carried out by reaction of water soluble silicates with water soluble aluminates in the presence of water. For this purpose, aqueous solutions of the starting materials can be mixed together or one component present in the solid condition is reacted with the other as an aqueous solution. By mixing both components present in the solid condition in the presence of water, there is also obtained the desired aluminum silicate. Also, it can be produced from $Al(OH)_3$, $Al_2O_3$, or $SiO_2$ by reaction with alkali silicate (e.g., sodium silicate or potassium silicate) or alkali aluminate (e.g., sodium aluminate or potassium aluminate) solutions. The production can also be carried out by further known processes. Especially the invention relates to aluminum silicates which a three-dimensional crystal lattice structure.

The preferred calcium binding capacity in the range of about 100 to 200 mg CaO/g of aluminum silicate, for the most part about 100 to 180 mg CaO/g of aluminum silicate, are present above all in compounds of the composition:

$$0.7\text{–}1.1\ Na_2O.Al_2O_3.1.3\text{–}3.3\ SiO_2.$$

This summation formula includes two types of different crystal structures (or their noncrystalline foreproducts), which also differ in their summation formulation. They are as follows:

(1) $0.7\text{–}1.1Na_2O.Al_2O_3.1.3\text{–}2.4\ SiO_2$
(2) $0.7\text{–}1.1Na_2O.Al_2O_3.2.4\text{–}3.3\ SiO_2$ The different crystal structures are seen in the X-ray diffraction patterns.

The crystalline aluminum silicate present in the aqueous suspension can be separated from the remaining aqueous solution and dried. Depending on the drying conditions, the product contains more or less bound water. However, the aluminum silicate used after its production for the preparation of the washing agent builder of the invention in the main are not dried but rather there can be used, and this is especially advantageous, an aluminum silicate still wet from its production.

The particle size of the individual aluminum silicate particles can be different and, e.g., be in the range between 0.1$\mu$ and 0.1 mm. This data refers to the primary particle size, i.e., the size of the particles in the precipitation and in a given case the particles resulting in the subsequent crystallization. There is used with especially advantage aluminum silicates which consist of at least 80 wt. % of particles of a size from 10 to 0.01 $\mu$m, especially 8 to 0.1 $\mu$m.

Preferably, these aluminum silicates contain no primary or secondary particles having diameters above 45 $\mu$m. As secondary particles, there are designated particles which are formed by agglomeration of primary particles to larger structures.

In regard to the agglomeration of the primary particles to larger structues especially has proven good the use of the aluminum silicate still out from its production for the production of the washing agent builder of the invention since it has proven that by using this still wet product there is practically completely stopped the formation of secondary particles.

In an especially preferred form of the invention, there is employed as component A powdered zeolite of Type A having a particular defined particle spectrum.

This type of zeolite powder can be produced according to German AS No. 2447021, German AS No. 2517218 (and related Roebke U.S. Pat. No. 4073867), German OS No. 2652419 (and related Strack U.S. Pat. No. 4,303,628), German OS No. 2651420 (and related Strack U.S. Pat. No. 4,303,626), German OS No. 2651436 (and related Strack U.S. Pat. No. 4,305,916), German OS No. 2651437 (and related Strack U.S. Pat. No. 4,303,627), German OS No. 2651445 or German OS No. 2651485 (and related Strack U.S. Pat. No.

4,303,629). The entire disclosure of the Roebke and Strack U.S. patents are hereby incorporated by reference and relied upon. The zeolites made according to these U.S. patents and published German applications have the particle distribution curves described therein.

In an especially preferred form, there can be used a powdered zeolite of Type A which has the particle size distribution described in German OS No. 2651485 (and related Strack U.S. Pat. No. 4,303,629).

As nonionic tensides there are usable the addition products of 4 to 40, preferably 4 to 20 moles of ethylene oxide to 1 mole of a fatty alcohol, e.g., stearyl alcohol, cetyl alcohol or oleylalcohol, or an alkylphenol, e.g., nonylphenol, octylphenol or decylphenol, or a fatty acid, e.g., stearic acid, palimitic acid, oleic acid or lauric acid, or a fatty amine, e.g., stearylamine or oleylamine, or a fatty acid amide, e.g., stearamide or oleamide or an alkanesulforamide, e.g., octadecylsulfonamide. Especially important are the addition products of 5–16 moles of ethylene oxide to coco or tallow fatty alcohols, to oleyl alcohol or to secondary alcohols having 8–18, preferably 12–18 carbon atoms, as well as to mono or dialkylphenols having 6–14 carbon atoms in the alkyl groups. Of particular interest is the addition product of 5 moles of ethylene oxide to tallow fatty alcohol. However, in addition to those water soluble nonionic tensides, however, there are of interest none or not completely water soluble polyglycol ethers having 1–4 ethylene glycol ether groups in the molecule, especially if they are employed together with water soluble nonionic or anionic tensides.

Furthermore, there are usable as nonionic tensides the water soluble 20–250 ethylene glycol ether groups and 10–100 propylene glycol ether groups containing addition products of ethylene oxide to polypropylene glycol, alkylenediamine polypropylene glycol and alkylpropylene glycols having 1–10 carbon atoms in the alkyl chain in which the polypropylene glycol chain functions as a hydrophobic group.

Also, there are usable nonionic tensides of the type of the amine oxides or sulfoxide.

Of especial interest for the use as nonionic tenside is a mixture of at least two different fatty alcohol ethoxylates based on isotridecylalcohol or an aliphatic $C_{13}$-alcohol and ethylene oxide. This mixture can preferably consist of fatty alcohoethoxylates having 4.5 to 5.5 EO units and fatty alcohol ethoxylates having 6 to 8 EO units.

Furthermore, as nonionic tenside there can be used a mixture of at least two different alkylphenol ethoxylates of the formula

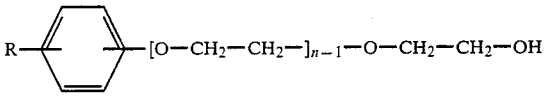

II

Thereby, R can be an aliphatic group (e.g., an alkyl group) having 1 to 15 carbon atoms, for example $—CH_3$, $—C_2H_5$, propyl, butyl, pentyl, hexyl, heptyl, octyl and nonyl, preferably having 9 carbon atoms as nonyl. The group R can be substituted in the ortho, meter and/or para position. There can also be employed mixtures in which in addition to the p-substituted aryl ring there is also present o-substituted benzene ring. There are employed mixtures in which up to 90% of the p-substitution and up to 10% of an ortho substitution.

In one of the alkylphenol ethoxylates in the mixture n can be 2 to 7, preferably 4 to 6, especially 5 and in the other alkylphenol ethoxylate 8 to 15, preferably 8 to 12, especially 9 or 10. n, however, can also at times be 7 or 9 or 12 in mixtures of alkylphenolates.

The alkylphenolethoxylate and the isotridecyl alcohol ethoxylate at times can be employed in any desired mixture, preferably in a ratio of 1:9 to 9:1, preferably 2:3 to 3:2 especially 0.9:1 to 1.1:0.9. Thereby corresponds these alkylphenolethoxylates of the formula in which R is nonyl and n is 5 or 9.

As alkalis there can be employed NaOH and/or KOH. The production of the granulate form washing agent builder of the invention can be carried out by mixing the individual components with each other, one adjusted to a consistency suited for a spray drying through measurement of the amount of water and the thus obtained suspension spray dried according to known processes.

The granulated washing agent builder of the invention is stable in transportation, has good redispersibility and is extremely low in dust.

Furthermore, the product of the invention has an extremely high absorption capacity for water and tensides.

Because of its particulate state, the granulated washing agent builder of the invention can be processed with the other particulate washing agent component particles to prepare a washing agent by simple mixing. A demixing of the mixture does not occur.

BRIEF DESCRIPTION OF THE DRAWINGS

The single figure of the drawings illustrates an apparatus for forming the granulated builder of the invention.

The composition can comprise, consist essentially of, or consist of the stated materials.

DETAILED DESCRIPTION

There was produced a zeolite A filter cake according to German OS No. 2651485 (and related Stark U.S. Pat. No. 4,303,629). The powdered zeolite of type A obtained thereby had the particle spectrum set forth in the German OS (and the Stark patent).

The zeolite A filter cake was stirred with a Dissolver and subsequently tempered in a 50 liter vessel at 45° C. At this point there was stirred in a nonionic tenside at 75–76 rpm with an MIG 15 foot stirrer, whereby the temperature of the slurry increased to 50° C.

Thereby were employed the following materials as nonionic tensides:

1. Isotridecyl alcohol ethoxylate 5 Mol EO
2. Isotridecyl alcohol ethoxylate 6.75 Mol EO
3. Nonylphenol ethoxylate 5 EO
4. Nonylphenol ethoxylate 9 EO
5. Tallow alcohol ethoxylate 5 EO The suspension obtained was mixed with the remaining components set forth in the tables and the product subsequently spray dried (nozzle drier, entrance temperature 180° C., outgoing air temperature 75° C.).

The results are set forth in following Table I.

TABLE I

| Example | 1. Comparison Example | 2. According to the Invention | 3. According to the Invention | 4. According to the Invention | 5. Comparison Example |
|---|---|---|---|---|---|
| Recipe data | | | | | |
| Zeolite A % | 77.0 | 77.0 | 77.0 | 77.0 | 77.0 |
| Tallow alcohol + 5 EO % | 2.6 | —/— | 2.6 | —/— | |
| Nonylphenol 5 EO % | —/— | 1.3 | —/— | —/— | —/— |
| Nonylphenol 9 EO % | —/— | 1.3 | —/— | —/— | —/— |
| Isotridecyl alcohol 5 EO | —/— | —/— | —/— | 1.3 | —/— |
| Isotridecyl alcohol 6.75 EO | —/— | —/— | —/— | 1.3 | —/— |
| Sodium sulfate % | 4.9 | 4.4 | 4.4 | 4.4 | 8.0 |
| Soda lye % | 0.5 | 0.5 | 0.5 | 0.5 | —/— |
| CMC/MC* % | 0 | 0.5 | 0.5 | 0.5 | —/— |
| Water % | 15.0 | 15.0 | 15.0 | 15.0 | 15.0 |
| Product data (Average value) | | | | | |
| Bulk density g/l | 530 | 490 | 490 | 495 | 550 |
| Particle spectrum | | | | | |
| >1.6 mm % | 0 | 0 | 0 | 0 | 0 |
| >0.8 mm % | 0 | 1 | 1 | 2 | 0 |
| >0.4 mm % | 0 | 23 | 21 | 22 | 25 |
| >0.2 mm % | 32 | 57 | 58 | 56 | 58 |
| >0.1 mm % | 52 | 17 | 18 | 18 | 14 |
| <0.1 mm % | 16 | 2 | 2 | 2 | 3 |
| Dust test according to Dr. Groschopp | 0.32 | 0.06 | 0.07 | 0.07 | 0.16 |

*CMC is carboxymethylcellulose
MC is methyl cellulose

The dust test according to Dr. Groschopp is carried out as follows:

The powder falling via shaking trough into a cylinder is caught in a container standing below the shaking position, while the dust portion outside this container deposits on the bottom plate of the cylinder and can be determined growimetrically. Thereby there is used the following apparatuses.

Apparatus for the determination of the dust consisting of the shaking trough.

Producer: AEG, Type DR 50

220 V 50 Hz, 0.15 A.

Outer cylinder

Height: 70 cm, diameter 40 cm closed above, open below

The cover plate is provided in the middle with a circular opening (diameter: 3 cm) for receiving the filling tube.

Inner cylinder

Height: 10 cm, diameter: 18 cm closed below, open above

Bottom plate

Shape: Round

Diameter: 48 cm

Filling tube

Length: 30 cm, Diameter: 2.5 cm

Depth of immersion of the tube in the outer cylinder: 20 cm.

The depth of immersion is held constant by a brass disc (diameter 15 cm, thickness: 1 mm) soldered to the outer wall of the filling tube.

Funnel

Upper diameter: 15 cm

Diameter of the outlet: 1.8 cm

Length of the funnel tube: 8 cm

The apparatus is set forth in the drawings. As shown in the drawings, the shaking trough 2 having is positioned on a laboratory table and is below the supply funnel. The arrangement of the rest of the apparatus is such that the outlet of the shaking trough lies directly over the middle of the funnel 3 and its distance from the upper edge of the funnel is 5.5 cm.

Illustration 100 grams of the sample is brought into the shaking trough 2 via the supply funnel 3.

The frequency of the shaking trough is 50 Hz and the open gap is established such that the material has run through the shaking rough in 1 minute.

The powder falls through a funnel 3 and a filling tube 4 into the inner cylinder 5 of the test apparatus which is below the filling tube, while the dust is collected outside this inner cylinder on the bottom plate 6 of the outer cylinder 7.

After the end of the powder running through the shaking trough, any powder remaining in the funnel 3 is conveyed into the apparatus by carefully rapping the funnel.

With low dust products deposition is continued for 1 minute, with dusty material the deposition time is extended to 2 minutes.

The dust deposited on the blank polished bottom plate is transferred with a metal spatula into the scale of a balance and weighed.

The dust content is given in percent based on the weighed portion.

With the spray dried washing agent builder of the invention which contains the nonionic tenside tallow alcohol 5 EO (Example 3) there was test the pneumatic respectively mechanical conveying properties.

For the evaluation of the conveyed material there were measured the changes in the bulk density and in the flow behavior.

The sample was conveyed via an increasing screw conveyor into a material separator. Thereby the controllable driving motor was adjusted to a low rotation of 300 rpm.

| Technical Data: | |
|---|---|
| Screw Conveyor System RO-FO, Type RF 80/D | |
| Number of revolutions of driving motor | 300 rpm |
| Length of conveyance | 6.9 m, of which 1 tube bead 45°, 3 m Radius |

-continued

| Technical Data: | | |
|---|---|---|
| | 4 m tube, 45° increasing to outlet | |
| Height of conveyor | 2.2 m | |
| Tubular screw conveyor | 80 mm diameter | |
| Conveyor capacity | 1650 kg/h | |
| Washing agent builder | Bulk density g/l | Height of Cone mm |
| Before conveyance | 490 | 28 |
| After conveyance | 490 | 29 |

Results

With the conveyed material there is seen nearly no change in the bulk density. The washing agent builder granulate is not destroyed.

The extremely good adsorption capacity can be seen from the following experiments in which the sample according to Example 3 is employed.

| Sample No. | % $H_2O$ | Flowability (fresh) |
|---|---|---|
| 1 | — | 1 |
| 2 | 3.6 | 1 |
| 3 | 7.1 | 1 |
| 4 | 10.7 | 1 |
| 5 | 14.3 | 1 |
| 6 | 17.9 | 1 |
| 7 | 21.4 | 1 |
| 8 | 25.0 | 1 |
| 9* | 36.0 | 2 |
| 10 | 43.0 | 6 |

Sample No. 9 contains agglomerates up to about 2 mm, which, however, are easily crushed.

Scale: 1 = very good, 6 = no longer flowable.

The determination of the flowability is described in the series of papers "Pigmente der Degussa AG No. 50", page 11.

The entire disclosure of German priority application No. P3504450.0 is hereby incorporated by reference.

What is claimed is:

1. A granulated washing agent builder consisting of 70 to 80 wt. % of a water insoluble silicate capable of binding calcium, the silicate being in the form of a finely divided, bound water containing, synthetically produced crystalline compound of the general formula $$(Kat_{2/n}O)_x.Me_2O_3.(SiO_2)_y \quad (I),$$

in that Kat is a cation exchangeable with calcium and having the valence n, x is a number from 0.7 to 1.5, Me is boron or aluminum and y is a number from 0.8 to 6, 4 to 5 Wt.-% sodium sulfate 2 to 3 Wt.-% nonionic tenside 0 to 1 Wt.-% alkali 0.5 to 1 Wt.-% carboxymethylcellulose, methylcellulose or a mixture thereof balance Water.

2. A builder according to claim 1 wherein Me is aluminum.

3. A builder according to claim 2 wherein the crystalline compound is zeolite of type A.

4. A builder according to claim 1 wherein the crystalline compound has the formula $$0.7\text{–}1.1\ Na_2O.Al_2O_3.1.3\text{–}3.3\ SiO_2.$$

5. A builder according to claim 4 wherein the tenside is an isotridecyl alcohol ethoxylate containing 4.5 to 8 EO units.

* * * * *